United States Patent [19]

Yanagawa et al.

[11] Patent Number: 4,943,319

[45] Date of Patent: Jul. 24, 1990

[54] PROCESS FOR PRODUCING HIGHLY FUNCTIONAL COMPOSITE MATERIAL AND COMPOSITE MATERIAL OBTAINED THEREBY

[75] Inventors: Masahiro Yanagawa; Mutsumi Abe; Kenichi Aota, all of Kobe; Takashi Motoda, Hyogo, all of Japan

[73] Assignee: Kabushiki Kaisha Kobe Seiko Sho, Kobe, Japan

[21] Appl. No.: 292,312

[22] Filed: Dec. 30, 1988

[30] Foreign Application Priority Data

May 18, 1988 [JP] Japan ..... 63-121564
Aug. 26, 1988 [JP] Japan ..... 63-212910

[51] Int. Cl.[5] ..... B22F 1/00

[52] U.S. Cl. ..... 75/229; 75/249; 75/247; 419/24; 419/38; 419/39; 419/66; 419/48

[58] Field of Search ..... 419/24, 38, 39, 54, 419/48; 428/567, 551; 75/249, 229

[56] References Cited

U.S. PATENT DOCUMENTS 3,472,656 10/1969 Krey ..... 75/214

FOREIGN PATENT DOCUMENTS 2824257 2/1978 Fed. Rep. of Germany .
644813 10/1950 United Kingdom .
732029 6/1955 United Kingdom .

OTHER PUBLICATIONS

Ferromagnetic Aluminum Composite Material, Dr. Mutusumi Abe, et al.

*Primary Examiner*—Stephen J. Lechert, Jr.
*Assistant Examiner*—N. Bhat
*Attorney, Agent, or Firm*—Oblon, Spivak, McClelland, Maier & Neustadt

[57] ABSTRACT

Disclosed is herein a process for producing a molding product of Al or Cu composite material, which comprises admixing a functional material capable of improving the desired property of the composite material by dispersion into a matrix to a powder of metal selected from Al, Cu or alloys thereof constituting the matrix, charging the dust directly into a molding die, applying cold dust core molding under the pressure of greater than 5 t/cm$^2$ of facial pressure and applying a diffusing treatment at a temperature higher than 300° C.

7 Claims, 5 Drawing Sheets

Al 200 μm OR MORE
Fe 200 μm OR MORE

Al 200μm OR MORE
Fe 100~200 μm

Al 200μm OR MORE
Fe 50~100 μm

Al 200 μm OR MORE
Fe 25~50 μm

PROCESS FOR PRODUCING HIGHLY FUNCTIONAL COMPOSITE MATERIAL AND COMPOSITE MATERIAL OBTAINED THEREBY

BACKGROUND OF THE INVENTION

2. Field of the Invention

The present invention concerns a process for efficiently producing a molding product of composite material based on Al, Al alloy, Cu or Cu alloy powder while securing required properties, as well as composite material obtained by such a process.

2. Description of the Prior Art

Since Al and Al alloy have the desirable properties of light weight, high-electrical conductivity, thermal conductivity, formability, etc., as well as the ability to be modified with ease in view of the strength by means of alloying, such materials are preferably used in the field of electronic and electric equipment parts, as well as various mechanical parts, for which reduction in the size and the weight is important. Further, in the field of electronic and electric equipment parts, there is an increasing demand for motors of reduced size and weight.

Although steel plate lamination type rotors have generally been used for conventional induction motors, it is difficult to change the speed of such motors with high accuracy solid rotors at high torque and low speed are now being reconsidered for power motors requiring control.

Further, rotors made of die cast aluminum used for high speed rotation (higher than 10,000 rpm) can not withstand centrifugal force. There is a demand for ferromagnetic materials of high electric conductivity for use in such motors.

Furthermore, along with the development for office or factory automation, use of electric equipments having magnetic disc memories have been increased more and more. Thus, magnetic shield structures have become important for possessing records in the magnetic disc memories, as well as it is a legal requirement to prevent electromagnetic wave noises from interferring with other electric equipments. There can be mentioned, as such an example, a precise motor for driving the magnetic head of a magnetic disc memory, for which an electromagnetic shield structure is required and more improvement has been demanded for the performance of the shield.

In a case where magnetic material of higher electric conductivity is required for the electromagnetic wave shield material or rotor material for the induction motor, since performance can not exceed the physical values inherent to Al, Cu and Cu alloy is used instead.

In view of these considerations, magnetic Al or Cu composite material has now been developed and, a method described, for example, in Japanese Patent Application Laid-Open Sho 57-51231 or 61-104040 has been proposed. The magnetic Al composite material described in the former is prepared by uniformly mixing a powder consisting of Al or Al alloy with a ferromagnetic metal powder at a ratio from 20 : 1 to 1 : 1 by weight, pressure molding the mixture and then sintering the compact at a temperature lower than the melting point of Al or Al alloy. The magnetic Al alloy disclosed in the latter application has been proposed by the present inventors and prepared by blending Al or Al alloy with 3 to 60% by weight of a of fiberous ferromagnetic material and then compressing under or after heating at 250° to 650° C. These composite materials have now been noted as new type of magnetic material in which magnetic properties derived from the ferromagnetic metal powder are added to the features of the Al or Al alloy (light weight, workability, electric conductivity, etc.).

However, since the amount of the ferromagnetic material contained in the magnetic Al composite material described in the above-mentioned patent publications is, less than 50% or less than 60% at the maximum as from 20 : 1 to 1 ; 1 by weight or from 3 to 60% by weight, the magnetic flux density under the conditions of the low magnetic field usually employed (about 100 Oe) is extremely small and can not be said to satisfy the required performance for the ferromagnetic material.

By the way, when magnetic properties were measured for the Al composite material solidified in accordance with the method of the above-mentioned prior art by varying the addition amount of ferrous material within a range from 1 to 80% by volume fraction (Vf), a graph as shown in FIG. 5 was obtained. The magnetic property was evaluated based on the magnetic flux density B (gauss (G)) of a specimen disposed under the magnetic field of 100 oersted (Oe). As can be seen from FIG. 5, the magnetic flux density (B) at Vf=25% is 1100 (G) and the magnetic flux density (B) at Vf=34% is 2000 (G). As compared with the magnetic flux density (B) of pure iron at 17600 (G), it is apparent that the value is extremely low in the Al composite material undergoing the restriction in the blending amount of the ferrous material (less than 39%) and it can not be said that the function as the soft magnetic material is sufficiently possessed.

Accordingly, the magnetic Al or Cu alloy utilized at present has not yet been quite satisfactory but leaves room for improvement. That is, the magnetic Al or Cu alloy is prepared by dispersing a ferromagnetic powder such as an iron powder into an Al or Cu powder and then molding them, and there is a need for improving the electric conductivity and the magnetic performance in order to enhance the shielding performance (reflection efficiency, etc.) as the electromagnetic wave shield material, as well as the rotor material used for induction motors.

The conventional method of producing Al or Cu composite material molding products can be classified mainly into the following three methods.

(1) A method of finishing material molded by means of extrusion, hot-pressing, HIP, etc. into a final shape by machining.

(2) A method of cold or hot forging material obtained by extrusion molding and then finishing into a final shape by machining.

(3) A method of compacting a powdery raw material (compact powder), degreasing, applying cold or hot forging and then finishing into a final shape by machining.

Referring at first to the method (1) above, there is a problem that to obtain a part of complicated shape much material must be cut away. The economic loss is particularly great when using expensive powdery metal material. Further, in a case of compositing Al or Al alloy powder, or Cu or Cu alloy powder (hereinafter referred to as a matrix metal powder) with functional material of other metal or alloy powder, if the material is exposed to high temperature condition, particularly, semi-molten state, there is a problem that an intermetallic compound is formed at the boundary between both of them which greatly reduces the physical properties of the composite material molding product. Then, since cutting dusts containing the intermetallic compound cannot be utilized even if they are recovered as scraps, the economic loss is greater.

Referring next to the method (2) above, although it shows high material yield as compared with the method (1), it is necessary to apply extrusion and to cut the product into slabs prior to cold or hot forging, which results in wasteful cut portions, as well as requiring considerable cutting cost. In addition, shape control in the extrusion molding step is only possible for the two-dimensional control and three-dimension shape control is extremely difficult, thus imposing a restriction on the shape of the preliminary molding product as the object of the cold or hot forging. In addition to such problems, since starting powder material capable of near-net shaping has to be applied with extrusion molding into a rod-like slabs (material for forging) prior to the cold or hot forging, it is uneconomical in view of the material and the step to increase the production cost, unless special effect is recognized in the performance of the products.

On the contrary, the method (3) described above is improved as compared with the method (2) in view of the problems due to the formation of the extrusion molded slabs (resulting in many cut portion, difficulty in the shape of three-dimensional slab, near-net shaping, etc. Furthermore, mass production is possible by the introduction of a powdery forging facility for continuously practicing the respective steps of compacting, degreasing and forging, by which there can be made a considerable improvement in view of the economical merit. However, it is necessary in this method to blend a lubricant such as zinc stearate or wax upon mixing the starting powder material with an aim of improving the mold releasability upon extracting the compact molding product from a molding die.

Although the lubricant is decomposed and sublimated in the degreasing step, it partially remains in the compact molding product and causes reduction in the strength of the molding product. Also, the lubricant adheres to the surface of the compact molding product and deteriorates the surface properties after forging. In addition, since the degreasing step is usually conducted at a temperature higher than 450° C., reaction is takes place between the matrix metal powder and the added functional metal powder to form an intermetallic compound at the boundary between them which deteriorates the physical properties. If the blending amount of the added metal powder is increased with an aim of compensating the reduction, there is another problem that other properties are deteriorated.

BRIEF SUMMARY OF THE INVENTION

The first object of the present invention is to further improve the method (3) described above with less material loss in a relatively simple step and obtain a process capable of efficiently producing a molding product of Al or Cu composite material of satisfactory physical properties at a reduced cost.

That is, the method (3), being referred to as a powder forging method combining the compact molding and forging, has an advantage in view of the material loss or production steps as has been described above, but it involves some problems in view of the physical properties of the molding product as has been described above.

It is intended in the present invention to attain the foregoing objects by overcoming the drawbacks in such powder forging methods and, further, making the step more reasonable or rational.

The second object of the present invention is to provide composite material having more excellent properties than those of conventional Al or Cu type composite materials, by using the improved production process according to the present invention provided for attaining the first object.

DESCRIPTION OF THE PREFERRED EMBODIMENTS

Figure 1:
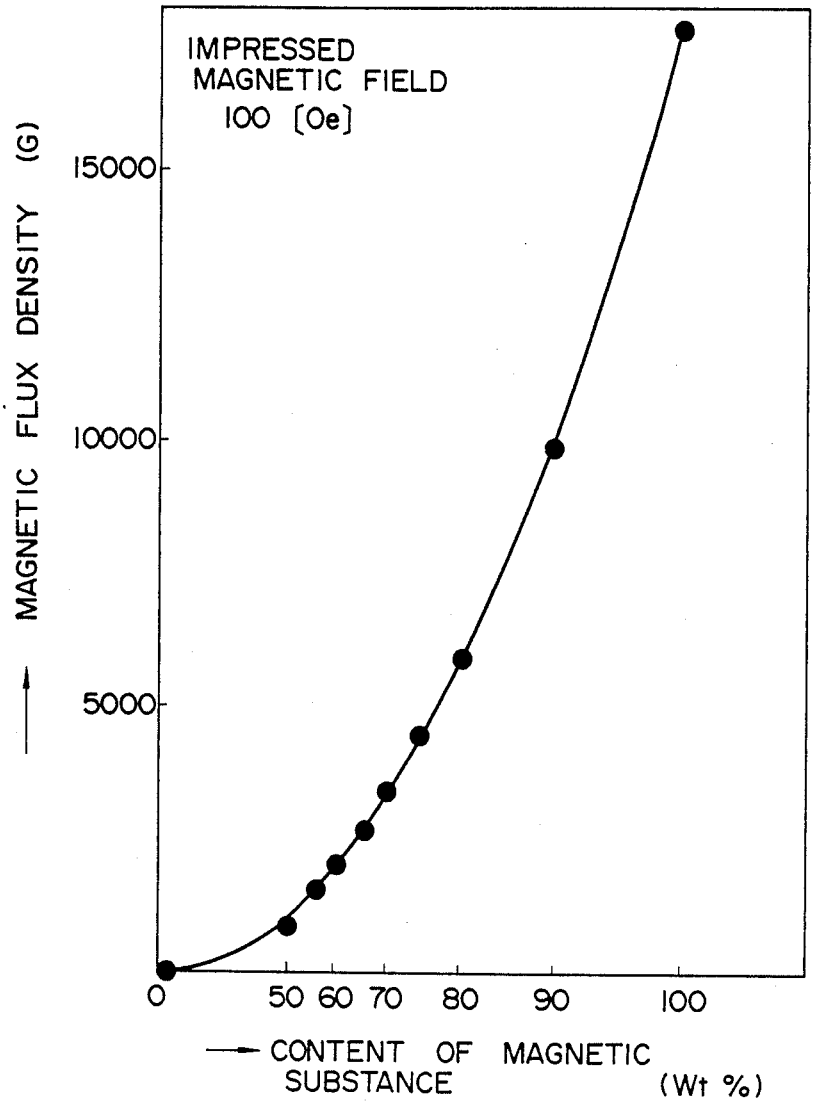
FIG. 1 is a graph illustrating a relationship between Fe content in Al composite material and the magnetic flux density.

In a fundamental point of view, forging is a technique for forming or shaping metal material by the impact shock a toughenig heavy weight dropping body. A preliminary molding product such as a cast product is utilized as the metal material to be forged. In powder forging, compact molding is conducted for the starting material powder with an aim toward preparing the preliminary molding product. It is considered difficult in the field of powder forging, to enter into the forging step without an intervening compact molding step. On the other hand, in a case where forging is omitted while applying only the compact molding, it is impossible to obtain a sufficiently increased density in the molding product, thereby failing to provide a molding product with satisfactory physical properties (such as strength). For the reasons described above, a method of conducting the compact molding step and the forging step successively with the degreasing step being intervened therebetween is employed at present in the molding of starting powder material by means of forging.

On the contrary, in the process according to the present invention, a sufficiently mixed raw material (hereinafter simply referred to as the starting powder material since the powdery starting material is usually employed) is subjected to a compact molding step, which is conducted at a plane or face pressure much higher than the facial pressure which is usually employed for compact molding. Rather, it is conducted at a facial pressure that is used in cold forging, and the resultant solidified product is subjected to a diffusing treatment (heat treatment for diffusion bonding) at a temperature higher than a predetermined temperature.

That is, the compact molding step in the process according to the present invention is not a preliminary molding step but a step of compressing and molding the starting powder material up to the final product density, in which individual starting material powders are compulsorily formed plastically due to the remarkably high facial pressure, the oxidized films at the powder surface are broken to reveal the fresh surface and a molding product is formed in which the fresh surfaces are brought into contact with each other. If such compact molding product is heated to a high temperature, diffusion occurs vigorously at the boundary where the fresh surfaces of the starting powders are brought into contact with each other to easily obtain firm metal bondings. Since there is no contact between fresh surfaces of conventional compact molding product even when it is heated to a high temperature, no such firm metal bonding can be obtained. On the other hand, no firm metal bonding can be expected by merely applying compact molding at high pressure. In this way, it is possible in accordance with the present invention to omit the forging step by applying compact molding at a rather high pressure and then applying diffusion by heat treatment, as well as to obtain a near net shaping by using the starting powder material to greatly reduce the product cost both in view of the productivity and the material cost. Furthermore, since the facial pressure upon compact molding is remarkably high, the starting material powder flows as if it were in a liquidous form and, as a result, even a product of complicated shape can be molded with no troubles. In the conventional compact molding, although divisional molding dies are employed in view of the exchangeability of the die, it is desirable in the present invention to preferably employ a one piece molding die although a divisional molding die may be used, because the compact molding is carried out at a considerably high pressure.

Referring more specifically, to the process according to the present invention, a starting material powder supplied to the compact molding step is prepared, for example, by adding other functional metal powder to Al powder and mixing them by using V-type mixer, etc. As the functional metal to be added, there can be exemplified Fe, stainless steel, Zn, Pb, Sn, Ni, Si, Cr, Mn, Cu, as well as alloys thereof. As the ceramics added, there can be exemplified SiC, $Al_2O_3$, TiN, TiC, etc. They may be powdery, fiberous, etc. The ratio of addition is desirably from 5 to 90% by volume fraction (Vf). If Vf is less than 5%, the compositing effect is insufficient. On the other hand, if Vf exceeds 90%, Al bonding force becomes insufficient. A lubricant such as zinc stearate is coated or blown while being dissolved in water or organic solvent, as required, into a molding die, followed by drying and then the starting material powder is charged by a predetermined amount into the die. Then, a facial pressure of greater than 5 t/cm$^2$, preferably, greater than 10 t/cm$^2$ is applied and compact molding is conducted by one-punch step. Then, the molding product is taken out from the die by the usual de-molding method, for example, by a knock-out method, which is then applied with diffusing treatment by heating to a temperature of from 300° to 500° C., preferably, about 400° to 450° C. If the heating temperature is lower than 300° C., The process is not efficient requiring a long time for the diffusion. On the contrary, if it is higher than 500° C., an intermetallic compound may be formed depending on the type of the added functional metal powder which may reduce the performance. The heating time is dependent on the heating temperature and tends to be shortened as the heating temperature is higher. If it is to short, the diffusion becomes insufficient. On the other hand, if it is too long, the productivity is reduced and the intermetallic compound is liable to be formed. Further, the atmosphere for the heating may be normal air but it is desirable to use. an inert gas or reducing gas atmosphere depending on the type of the added metal element or the application uses of the products to thereby prevent oxidation. In addition, it is not preferred in the present invention to add the lubricant to the starting powder as in the case of the conventional compact molding method, because if the lubricant is added to the starting powder, the lubricant would remain in the molding product even after the application of the degreasing treatment to hinder the diffusing treatment. However, it is greatly recommended that the lubricant be used to coat the inside of the molding die as required to improve the releasability of the product.

The present composite material molding product is not limited to the case of production by using only one type of a mixed powder, because there are diversified requirements for the properties depending on specific application uses thereof.

In a rotor, for example, while ferromagnetic and highly permeable properties are is required for the portion of a magnetic circuit, no such function is required for other portions and machinability for attaching or securing means are required elsewhere in a single part. In such a case, it is advantageous to constitute a portion of such a part with a molding product of mixed powder and to constitute other portions with, for example, easily machinable metal powder such as Al or mixed powder of different materials using a reduced mixing ratio for the functional material One then integrates both of them rather than forming the entire part with a metal powder or matrix in which the functional material is dispersed.

In the case of producing such a composite material molding product of different powders, a predetermined powder mixture is subjected to a compact molding into a predetermined shape, then a different powder mixture or metal powder is charged into an identical or separate molding die for, compact molding while being simultaneously integrated and bonded with the predetermined powder mixture molding product, in accordance with the shape of the molding product and the selection for the powder mixture or metal powder.

If the conditions allow, the molding is not conducted by two steps as described above, but a predetermined powder mixture and the different kind of powder are previously laminated and compact-molded in a molding die, and the compact molding for the powder and the bonding between different powders are conducted simultaneously in one punch step. Alternatively, it is also possible to set a bulky different material shape product together with a predetermined powder mixture instead of different powder mixture in a molding die and simultaneously conduct the compact molding for the powder portion and bonding between them in one punch step.

Figure 6A:
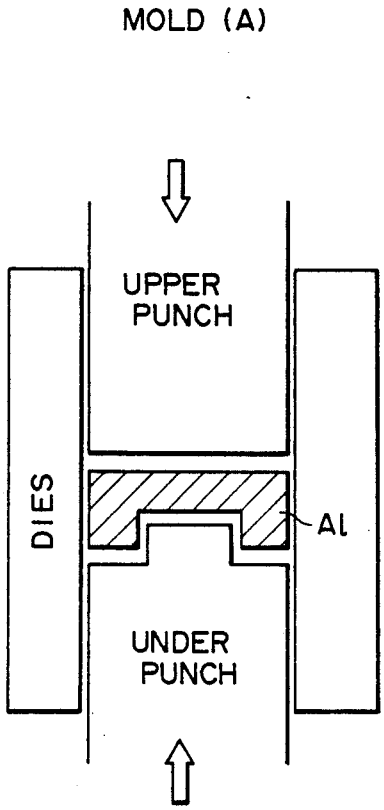
FIG. 6 is a step chart illustrating an embodiment of the production for a molding product of different kind powder composite material in which an Al powder molding product and an Al+Fe powder mixture molding product are molded integrally.
Figure 6B:
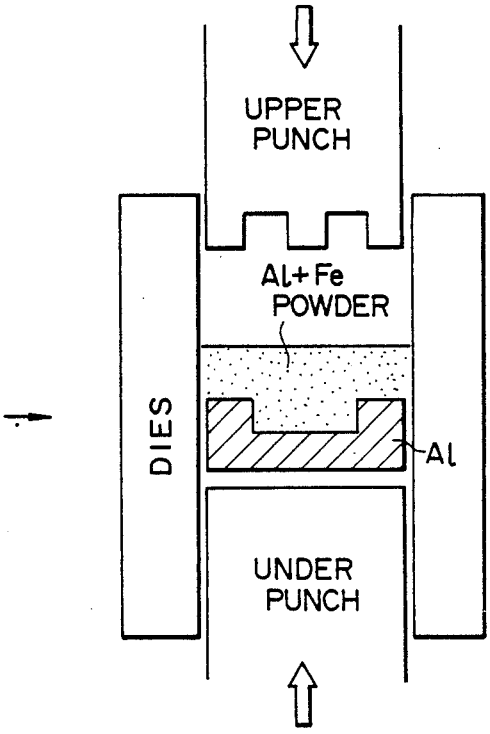
Figure 6C:
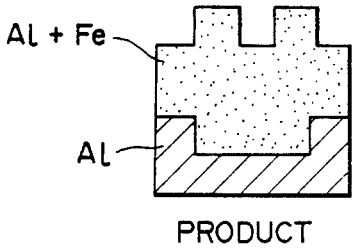

FIG. 6 (*a*)–(*c*) shows one embodiment for producing a composite molding product using Al powder as the different powder and Al+Fe powder as the powder mixture.

At first, in FIG. 6(*a*), compact molding for the Al powder charged in the dice is conducted from the vertical direction of the dice by the upper punch and the lower punch.

Then, in FIG. 6(*b*), the Al powder molding product described above is arranged with the opposite direction in the dice of the die (B) and the Al+Fe powder mixture is charged thereabove. Then, pressurization by the upper punch and the lower punch is conducted from the vertical direction of the dice to simultaneously attain the compact molding for the Al+Fe powder and the bonding of the Al powder molding product and the Al+Fe powder mixture molding product. FIG. 6(*c*) shows the composite molding product after the molding=product.

In this case, the dies (A) and (B) may be identical or different and the punching direction may be in one direction. Further, the sequence of molding the Al powder and Al+Fe powder mixture may be reversed.

Then, the conditions for the ingredients and the composition are to be explained in the case of Al composite material.

Figure 3:
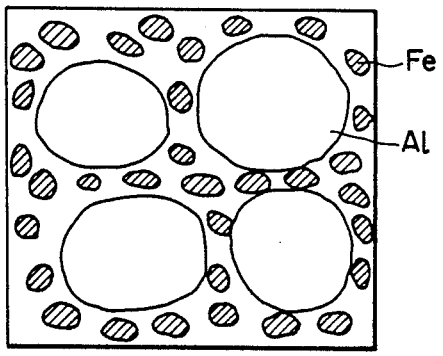
FIG. 3 is a schematic view illustrating the step of forming the metal tissue in a case where the grain size of ferrous powder is smaller than that of the Al powder.

In view of the present situations as described above, the present inventors have conducted an experiment for the effect of the ratio of blending ferromagnetic material to Al on the magnetic properties of the composite material with an aim of obtaining Al composite material having magnetic properties at high level. As a result, it has been made apparent as shown in FIG. 3 that the magnetic flux density (G) in a case where the blending ratio of the ferromagnetic material is less than 50% is extremely small but it abruptly increases from the level near 50% of the blending ratio and, particularly, that magnetic properties outstandingly excellent as compared with those of the conventional magnetic Al composite materials can be obtained if the ferromagnetic material is blended by more than 60%. The ferromagnetic material usable in the present invention can include iron, cobalt, nickel, as well as various alloys including such metals and most general materials are iron, steel and alloyed steels from overall point of view for the magnetic property, physical property and economical merit. The shape of the material is powdery, flaky or fiberous so that the ferromagnetic material can be mixed uniformly with Al or Al alloy powder.

As explained referring to FIG. 1, it is necessary that the blending ratio of the ferromagnetic material to Al or Al alloy powder be more than 50% by weight. However, if it is excessive, since the absolute amount of the Al or Al alloy powder becomes insufficient, bonding force upon cold forming is insufficient making it difficult for solidification or deteriorating the physical property of the solidification product. Accordingly, the blending ratio of the ferromagnetic material has to be limited to less than 90%.

The preferred blending ratio of the ferromagnetic material does not change substantially depending on the shape of the ferromagnetic material (that is, powdery, flaky, acicular or fiberous), but it is defined as greater than 60% by weight and less than 90% by weight only in the case of the blending ratio for the fiberous ferromagnetic material for avoiding the overlap with the scope of the prior patent application.

Further, in the present invention, since the magnetic orientation of the composite material changes depending on the shape of the ferromagnetic material as evident in the examples detailed later and, since it shows isotropic orientation in the case of using powdery ferromagnetic material, planar orientation in the case of using flaky ferromagnetic material and uni-directional orientation in the case of using fiberous magnetic material, the shape of the ferromagnetic material may properly be selected depending on the magnetic orientation demanded. For instance, if isotropic magnetic property is required, powdery material may be used and, if magnetic anisotropy in the planar in one direction is required, flaky or fiberous magnetic material may be used, in which the anisotropy can further be increased by applying cold compact molding.

One reason that conventional magnetic Al composite materials show only low magnetic property, is that when an external magnetic field Ho is exerted a magnetic field in the opposite direction to that of the external magnetic field, that is, a counter electrode Hd is generated at the inside of the magnetic material represented by ferrous material, and the effective magnetic field (H=Ho−Hd) is lowered.

Figure 2A:
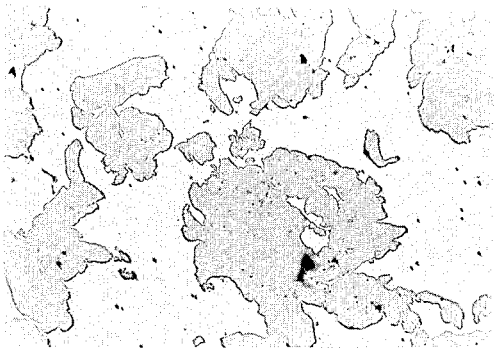
FIGS. 2(A)–(D) are photographs illustrating the metal tissue of the magnetic Al composite material of examples and comparative examples.
Figure 2B:
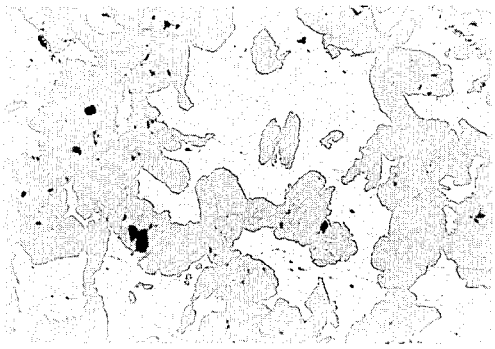
Figure 2C:
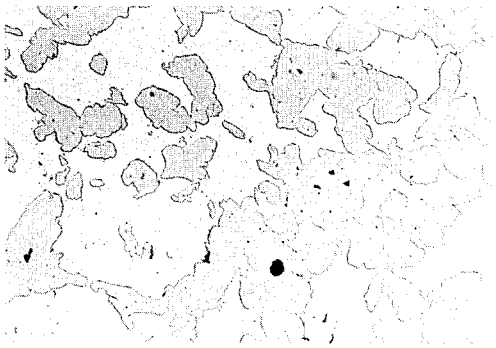
Figure 2D:
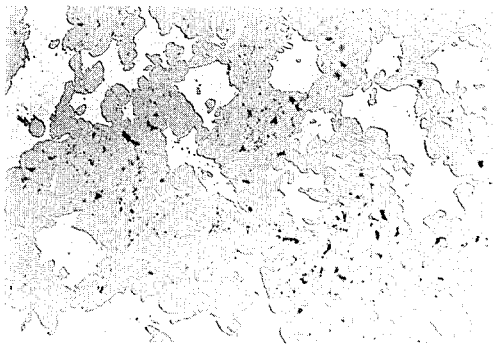

The present inventors have made various studies to develops effective means to overcome the effects of the counter magnetic field Hd. We have found that the counter magnetic field is reduced if the distribution of the magnetic material in the magnetic Al composite material is formed into a network structure as shown by the above-mentioned constitution, that is, such a structure in which magnetic materials are extended while being connected with each other. That is, referring to the distribution of the magnetic material in the magnetic Al composite material :

(1) in a case where individual magnetic material grains are present independently in the composite material (refer to FIG. 2(A), described later), respective magnetic material grains are magnetized independently under the effect of the external magnetic field, to thereby increase the counter magnetic field Hd, whereas, (2) in a case where the magnetic material grains are connected with each other to constitute a network structure (refer to FIGS. 2(B)-(D), described later), connected magnetic grains in the network structure are integrally magnetized under the effect of the external magnetic field, to thereby reduce the value for the counter magnetic field due to the magnetized magnetic material.

Figure 4:
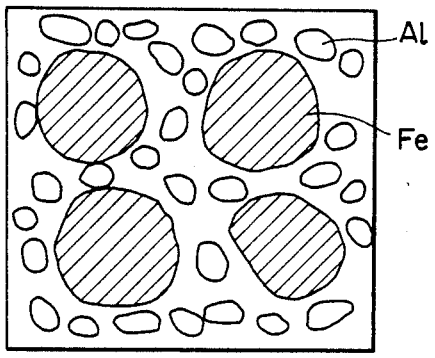
FIG. 4 is a schematic view illustrating the step of forming the metal tissue in a case where the grain size of the Al powder is smaller than that of the ferrous powder.
Figure 5:
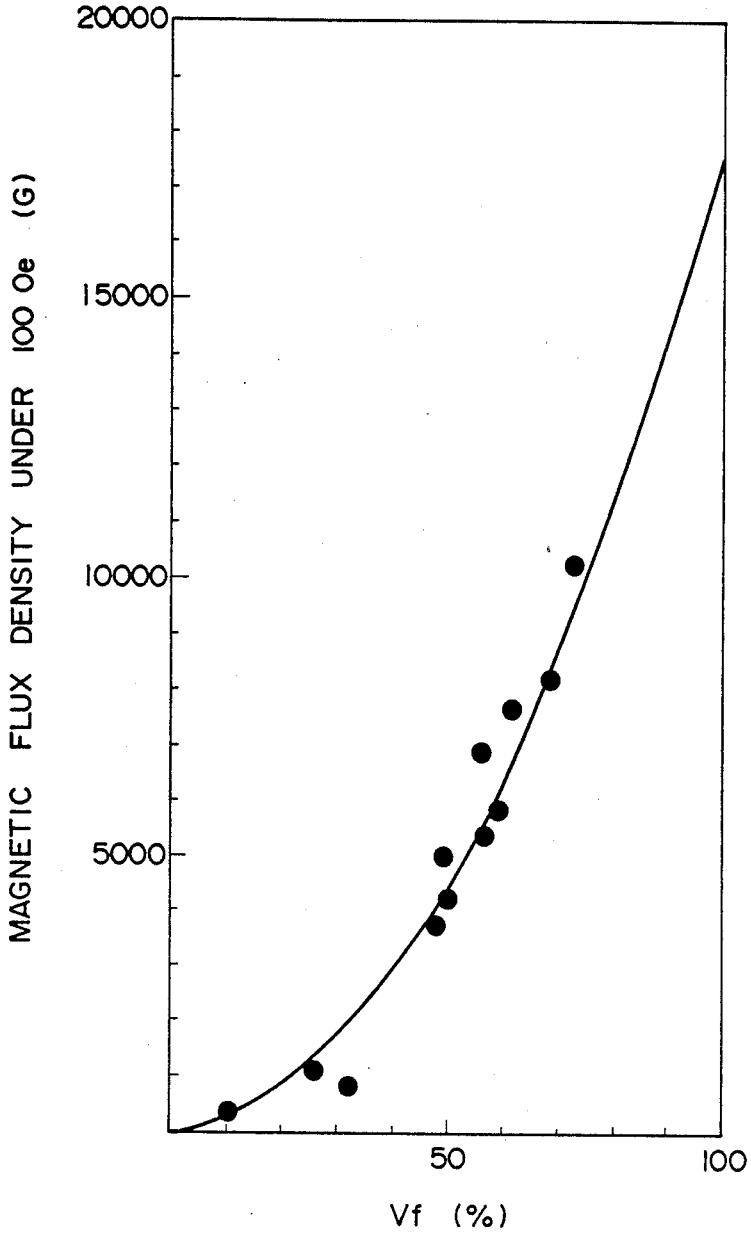
FIG. 5 is a graph illustrating a relationship between the volume fraction and the magnetic property.

As means for producing such magnetic Al composite material of reduced counter magnetic field, a method of producing a desired molding product by compression molding starting powder is employed in the present invention. In this case, the magnetic Al composite material of the network structure as described above can be obtained by using magnetic material powder of smaller grain size than that of Al or Al alloy powder, preferably, magnetic material with the grain size of less than ½ for that of the Al or Al alloy powder as the starting material. It is considered that the compression molding is conducted in a state where magnetic material powder enters into the gaps among the Al or Al alloy powder upon compression molding of the starting powder (refer to FIG. 3). On the contrary, in a case where the grain size of the magnetic material powder is coarser than that of the Al or Al alloy powder, the Al or Al alloy powder enters into the gaps among the magnetic material powders to result in a state where the magnetic material powder is dispersed highly independent of each other (refer to FIG. 4). In a case where the grain sizes are identical between both of them, they are intermixed with each other and the magnetic material can neither form the network structure.

The following is a description of the composition of the Cu composite material. It is common knowledge in the art that the magnetic alloys of high electric conductivity on Al metal are greatly superior to those of based on Cu in view of the light weight, workability and economical merit. Use of Cu which has a greater specific gravity, inferior workability (cold workability) and economical merit compared with Al can not be considered at all. However, compared Al Cu has the property of forming less intermetallic compounds with ferromagnetic materials, particularly, Fe. It has been found that a magnetic alloy of excellent magnetic performance can be obtained while preventing the formation of the intermetallic compound giving undesired effect on the magnetic performance and preventing the occurrence of fabrication strains by skillfully selecting molding conditions, etc. It has further been found that a magnetic alloy suitable to the use of electromagnetic wave shield material or rotor material in induction motors is available by utilizing Cu or Cu alloy which is superior Al in electric conductivity. The present invention has been accomplished based on such findings.

In the magnetic Cu alloy in accordance with the present invention, Fe, Ni, Co or alloys can be exemplified as the ferromagnetic material thereof and it is necessary that the ferromagnetic material is contained by from 10 to 85% by volume. If the content of the ferromagnetic material is less than 10% by volume, no effective magnetic property can be obtained. On the other hand, if the content of the ferromagnetic material exceeds 85% by volume, no intact consolidation can be obtained no matter how the conditions for consolidation are controlled. As the base material, Cu and Cu alloy can be exemplified. Among them, for the Cu alloy, there are no particular restrictions for the type so long as they show higher electric conductivity than Al and satisfactory workability as the fundamental feature. As the preferred Cu alloys, there can be mentioned Cu-Cd, Cu-Ag, Cu-Zr alloy, etc. In the present invention, it is necessary that the ferromagnetic material and the Cu or Cu alloy be integrated in a homogenous state for obtaining the magnetic performance with no anisotropy and, in this regard, it is required that minute ferromagnetic metal grains be dispersed in Cu or Cu alloy as the matrix. Further, as has been described above, it is indispensable that the ferromagnetic material and the Cu or Cu alloy be integrated by means of metal bonding without forming an intermetallic compound. As has been stated above, formation of the intermetallic compound would lead to a reduction in the magnetic property.

A desirable method of producing the magnetic Cu alloy according to the present invention comprises applying cold pressure-molding to the starting mixture of the composition described above and then causing diffusion between each metal powder by heat treatment thereby attaining integration by means of metal bonding. After conducting compact molding first at room temperature under a pressure of greater than 50 kg/mm$^2$, the resultant molding product is subjected to heat treatment temperature from 600° to 800° C. Since this method employs cold forming, it is capable of providing high dimensional accuracy and is advantageous for the molding of a products with complicated in the shapes. However, since fabrication strains remain after the step of cold forming, and bonding between minute starting grains is not sufficient, it is necessary to eliminate fabrication strains by diffusing atoms at the boundary between each of the minute grains by heat treatment . Thus, the heat treatment described above is conducted additionally. If the pressure for the cold forming is less than 50 kg/mm$^2$, no satisfactory cold forming can be obtained and the minute grains can not be bonded sufficiently with each other even if an otherwise sufficient heat treatment is subsequently applied. Further, if the temperature for the heat treatment is lower than 600° C., no satisfactory bonding state for the minute grains can be obtained because of insufficient diffusion. In addition, fabrication strains remain which deteriorate the magnetic property. On the other hand, if the temperature for the heat treatment exceeds 800° C. diffusion and solid solubilization between Cu and the ferromagnetic material proceed to form an intermetallic compound. This process results in the deterioration of the electric conductivity and the magnetic property.

As the form of the minute ferromagnetic grains in the present invention, there can be mentioned powdery, flaky, fiberous or like other form and, although there is no particular restriction to the size of the material, the grain size of about 20 to 200 um is recommended. Further, although there are no particular restrictions for the form and the size of the minute Cu or Cu alloy grains, powdery material with the grain size of less than 200 um is recommended.

EXAMPLE

EXAMPLE 1

Each of powders of Fe, Pb, Sn, Ni, Cr, Mn and Cu was added to pure Al powder by 40% by volume fraction (Vf), which was charged in a molding die coated with zinc stearate and applied with cold forging at a facial pressure of 12 t/cm$^2$. Subsequently, a diffusing treatment of heating them in an Ar atmosphere at 400° C. and maintaining at that temperature for 30 min was applied to obtain a consolidated molding product having a tensile strength of about 10 kg/mm$^2$.

Starting powder materials consisting only of Al alloy powder (6061) and consisting of a mixture of Al alloy powder (6061) and 40% Vf of alumina powder and ferrite powder were respectively applied with compact molding in the same manner as described above and then subjected to diffusing treatment to obtain consolidation molding products having tensile strength of 18 kg/mm2, 20 kg/mm2, 12 kg/mm$^2$ respectively.

EXAMPLE 2

Ferrous materials of powdery, flaky and fiberous forms were used as the ferromagnetic material, which were blended with Al powder prepared by the atomizing method at a ratio shown in Table 1 and then uniformly mixed. They were applied with cold forging at a facial pressure of 12 t/cm$^2$ and, further subjected to a diffusing treatment of maintaining at a temperature of 450° C. for 30 minutes to obtain solidification molding products. Annular test specimens each of 45 mm outer diameter, 35 mm inner diameter and 5 mm thickness were prepared from the respective resultant molding products and magnetic properties were measured for each of them (magnetic flux density and magnetic orientation).

The results are collectively shown in Table 1. FIG. 1 is a graph illustrating the result in Table 1 as a relationship between the Fe blending ratio and the magnetic flux density.

TABLE 1

| Exp. No. | Composition | Magnetic flux density (G) at 100 Oe | Magnetic orientation |
|---|---|---|---|
| 1 | Al-5% Fe (Powder) | 5 | Isotropic |
| 2 | Al-50% Fe (Powder) | 960 | " |
| 3 | Al-55% Fe (Powder) | 1600 | " |
| 4 | Al-60% Fe (Powder) | 2040 | " |
| 5 | Al-65% Fe (Powder) | 2680 | " |
| 6 | Al-70% Fe (Powder) | 3400 | " |
| 7 | Al-75% Fe (Powder) | 4400 | " |
| 8 | Al-75% Fe (Flaky powder) | 5200 | Planar orientation |
| 9 | Al-75% Fe (Fiber) | 6000 | Uni-directional orientation |
| 10 | Al-80% Fe (Powder) | 5900 | Isotropic |
| 11 | Al-90% Fe (Powder) | 9900 | Isotropic |
| 12 | 100% Fe | 17600 | Isotropic |

From Table 1, it is considered as below :

(1) Exp. Nos. 1 and 2 are Comparative Examples insufficient for the blending amount of the ferromagnetic material (Fe), in which the magnetic flux density at 100 Oe is as low as less than 1000 gauss, lacking in practicality as the magnetic material.

(2) Exp. Nos. 3–11 are Examples capable of satisfying the conditions defined in the present invention, all of which show high level magnetic property.

(3) Exp. Nos. 7, 8 and 9 demonstrate the comparison for the effect of the shape of Fe on the magnetic property, in which the magnetic flux density tends to be increased in the order of powdery product, flaky product and fiberous product. Further, it is evident for the magnetic orientation that the powdery product has isotropic property, the flaky product has planar orientation and the fiberous product has uni-directional orientation.

(4) Exp. No. 12 is a Comparative Example is excessive and, thus, the absolute amount of Al powder is insufficient. Since the pressure moldability is poor, the product can not be consolidated.

EXAMPLE 3

As shown in Table 2, various types of minute ferromagnetic grains and Cu powder were mixed. For cold forming (Examples 1–14), the each of the mixtures was charged in a forging die of 45 mm diameter, applied with cold pressing at a predetermined pressure under each of the conditions shown in Table 1 and then subjected to heat treatment respectively.

| No. | Matrix | Ferro-magnetic material | volume fraction (%) | Type | Molding temperature (°C.) | pressure (kg/mm$^2$) | $B_{100}$ (gauss) | Electric resistance (μΩ cm) | Strength (kg/mm$^2$) | Annealing temperature (°C.) | Remarks |
|---|---|---|---|---|---|---|---|---|---|---|---|
| 1 | Cu | Fe | 50 | grain | room temperature | 30 | TP fabrication impossible | 7.1 | 5 | 650 | X |
| 2 | " | " | 50 | " | room temperature | 40 | 4200 | 6.5 | 7 | 650 | X |
| 3 | " | " | 50 | " | room temperature | 50 | 5000 | 5.2 | 20 | 650 | |
| 4 | " | " | 50 | " | room temperature | 80 | 5100 | 5.1 | 23 | 650 | |
| 5 | " | " | 50 | " | room temperature | 100 | 5200 | 5.2 | 25 | 650 | |
| 6 | " | " | 50 | " | room temperature | 100 | 5050 | 5.1 | 25 | 650 | |
| 7 | " | " | 50 | " | room temperature | 100 | 5100 | 5.1 | 23 | 600 | |
| 8 | " | " | 50 | " | room temperature | 100 | 4500 | 5.1 | 13 | 550 | X |
| 9 | " | " | 50 | " | room temperature | 100 | 5310 | 5.2 | 22 | 750 | |
| 10 | " | " | 50 | " | room temperature | 100 | 5120 | 5.1 | 20 | 800 | |
| 11 | " | " | 50 | " | room temperature | 100 | 4150 | 5.7 | 24 | 830 | X |
| 12 | " | " | 80 | " | room temperature | 100 | 8400 | 6.7 | 20 | 850 | |
| 13 | " | " | 80 | flaky | room temperature | 100 | 8900 | 6.9 | 22 | 650 | |
| 14 | Al | Fe | 80 | grain | room tempera- | 100 | 6200 | 7.3 | 10 | 400 | — |

-continued

| No. | Matrix | Ferro-magnetic material | volume fraction (%) | Type | Molding tempera-ture (°C.) | pressure (kg/mm²) | $B_{100}$ (gauss) | Electric resistance (μΩ cm) | Strength (kg/mm²) | Annealing tempera-ture (°C.) | Re-marks |
|---|---|---|---|---|---|---|---|---|---|---|---|
| | | | | | ture | | | | | | |

: Example
X: Comparative Example
—: Conventional Example

Judging from the result of Experiment Nos. 1–5, it is necessary to increase the molding pressure in the case of cold forming, which has to be conducted under the pressure of greater than 50 kg/mm². Further, from the result of Experiment Nos. 7–11, the temperature for the heat treatment at 550° C. after the cold forming is insufficent (the strength is 13 kg/mm² and $B_{100}$ is 4800 gauss for No. 8) and the values are apparently inferior to the strength of 20 kg/mm² and $B_{100}$ of 5100 gauss in Nos. 6, 7, 8 and 9 applied with heat treatment at a temperature of from 600° to 800° C. On the other hand, Exp. No. 11 applied with heat treatment at a temperature of 830° C. has no problem in view of the strength but exhibits remarkable reduction in the performance ($B_{100}$) and increase in the electrical resistance (that is reduction in the electrical conductivity), because Fe contributing to the improvement of the magnetic performance and Cu contributing to the improvement of the electric conductivity are mutually solid-solubilized and abrased.

From the result as described above, it is necessary in the case of cold forming, to set the molding pressure to greater than 50 kg/mm² and the temperature for the heat treatment to 600–800° C.

As evident from the comparison between No. 14 and No. 12, excellent performance for all of the magnetic performance, electric conductivity and strength can be obtained for the magnetic Cu alloy according to the present invention as compared with the case of using Al as the matrix, if the identical ferromagnetic material is used.

EXAMPLE

The Al powder prepared by the atomizing method and the Fe powder prepared also by the atomizing method were respectively classified to prepare starting powder of the grain size of five steps as shown below :

I : greater than 200 um
II : greater than 100 um and less than 200 um
III : greater than 50 um and less than 100 um
VI : greater than 25 um and less than 50 um
V : less than 25 um Starting powder mixtures with the grain size and the composition as shown in Table 3 were prepared by using the starting powders classified as described above and, after molding them by cold forging, diffusing treatment was applied at a temperature of 450° C. for 30 min to obtain respective solidification molding products (at a facial pressure of 12 t/cm²).

A portion was cut-out from each of the molding products and fabricated into a ring-like test specimen of 45 mm outer diameter, 35 mm inner diameter and 5 mm thickness. Each of the specimens was wound therearound with coils for measuring the magnetic property. The magnetic property was evaluated by the magnetic flux density B (G) in the magnetic field of 100 (Oe).

TABLE 3

| No. | Al grain size | Fe grain size | Fe volume fraction | Magnetic flux density under 100 Oe | Eval-uation |
|---|---|---|---|---|---|
| 1 | 200 μm above | 200 μm above | 25% | 1100 | X |
| 2 | " | 100~200 μm | " | 1160 | |
| 3 | " | 50~100 μm | " | 1210 | |
| 4 | " | 25~50 μm | " | 1340 | |
| 5 | " | 25 μm below | " | 1380 | |
| 6 | 100~200 μm | 200 μm above | 35% | 1890 | X |
| 7 | " | 100~200 μm | " | 2170 | |
| 8 | " | 50~100 μm | " | 2250 | |
| 9 | " | 25~50 μm | " | 2390 | |
| 10 | " | 25 μm below | " | 2500 | |
| 11 | 200 μm above | 100~200 μm | 50% | 4610 | X |
| 12 | 100~200 μm | " | " | 4420 | X |
| 13 | 50~100 μm | " | " | 4200 | X |
| 14 | 25~50 μm | " | " | 4050 | X |
| 15 | 25 μm below | " | " | 3850 | X |
| 16 | 200 μm above | 200 μm above | 65% | 7470 | X |
| 17 | " | 100~200 μm | " | 7840 | |
| 18 | " | 50~100 μm | " | 7990 | |
| 19 | " | 25~50 μm | " | 8220 | |
| 20 | " | 25 μm below | " | 8310 | |
| 21 | " | 200 μm above | 80% | 11320 | X |
| 22 | " | 100~200 μm | " | 11550 | |
| 23 | " | 50~100 μm | " | 11900 | |
| 24 | " | 25~50 μm | " | 12110 | |
| 25 | " | 25 μm below | " | 12450 | |

As shown in Table 3, improvement for magnetic property was recognized in any of the examples using Fe powder with the smaller grain size than that of Al powder. Particularly, in examples using Fe powder of a grain size less than ½ for that of Al powder, more excellent improving effect was observed.

For the molding specimens of Nos 1–4 in Table 3, when the metal tissue and the values for the effective magnetic fields were examined, the photographs as shown in FIGS. 2(A)–(D) and the following data were obtained.

Value for the Magnetic Field

No. 1 3960 (G)
No. 2 4360 (G)
No. 3 4560 (G)
No. 4 4660 (G)

In No. 1, since the grain size of the Fe powder is large, Fe powders are present in a state independent from each other, whereas Nos. 2–4 have a network structure in which Fe powders are connected with each other and it has been confirmed that the values for the effective magnetic fields are excellent respectively as compared with that of No. 1.

What is claimed is:

1. A process for producing a composite molding product which comprises: forming a mixture of ferromagnetic metal with a powder of matrix metal selected from the group consisting of aluminum, copper and alloys thereof; charging the mixture directly into a molding dye; applying cold compact molding under pressure of greater than 5 T/cm$^2$ of facial pressure and applying a heat treatment for diffusion bonding at a temperature between about 300° C. to 800° C.

2. A production process as defined in claim 1, wherein the cold compact molding step is conducted at room temperature in one-punch step, resulting in a near net shape.

3. A production process as defined in claim 1 for the composite molding product comprising more than one type of mixed material wherein the compact molding step is conducted in one identical molding dye or separate molding dyes so that the different powder mixtures and the matrix metal powder are formed integrally.

4. A molding product of aluminum magnetic composite material made by the process of claim 3 wherein the ferromagnetic metal, in a form selected from granular, flaky or fibrous, is dispersed from 50–90% by wt. into a matrix metal consisting of aluminum or aluminum alloy powder, then the matrix metal and the ferromagnetic metal are integrated with each other by means of metal bonding with no substantial formation of intermetallic compound by the cold compact molding or subsequent heat diffusion treatment.

5. A molding product of copper magnetic composite material made by the process of claim 3 wherein the ferromagnetic metal, in a form selected from granular, flaky or fibrous, is dispersed from 10–85% by volume, into a matrix metal consisting of copper or copper alloy powder, then the matrix metal and the ferromagnetic metal are integrated with each other by means of metal bonding with no substantial formation of intermetallic compound by the cold compact molding or subsequent heat diffusion treatment.

6. A molding product of magnetic composite material as defined in claims 4 or 5, wherein the grain size of the ferromagnetic metal is smaller than that of the matrix metal grains, and a network structure between each of the ferromagnetic metal grains is formed around the matrix metal grains.

7. A molding product as defined in claims 4 or 5, wherein the molding product of the powder mixture and the molding product of the different type of powder mixture or the matrix metal powder are integrally bonded.

* * * * *